US007712160B2

(12) United States Patent
Pesta

(10) Patent No.: US 7,712,160 B2
(45) Date of Patent: May 11, 2010

(54) OBSTACLE AVOIDANCE METHOD FOR POOL COVERS USING ZIPPER ELEMENTS

(75) Inventor: LeeAnn Pesta, W. Babylon, NY (US)

(73) Assignee: Pool Cover Corp., Hauppauge, NY (US)

( * ) Notice: Subject to any disclaimer, the term of this patent is extended or adjusted under 35 U.S.C. 154(b) by 1078 days.

(21) Appl. No.: 11/394,292

(22) Filed: Mar. 29, 2006

(65) Prior Publication Data

US 2007/0226888 A1 Oct. 4, 2007

(51) Int. Cl.
*E04H 4/00* (2006.01)

(52) U.S. Cl. ..... 4/498

(58) Field of Classification Search ..... 4/498, 4/503, 494; 24/387, 388, 433, 435, 436; 160/DIG. 18
See application file for complete search history.

(56) References Cited

U.S. PATENT DOCUMENTS 1,135,764 A * 4/1915 Casey
1,819,349 A * 8/1931 Walrath
1,889,337 A * 11/1932 Legat
2,394,732 A * 2/1946 Williams
4,109,325 A 8/1978 Shuff
4,979,702 A * 12/1990 Franklin
5,068,929 A * 12/1991 Weiner
5,621,926 A * 4/1997 La Madaleine
5,722,098 A 3/1998 Stern
5,727,264 A * 3/1998 Craig
6,273,114 B1 * 8/2001 Schaefer
6,691,334 B2 2/2004 St-Hilaire
6,691,361 B2 * 2/2004 Rolfe et al. ..... 14/71.5
6,895,886 B1 * 5/2005 Pawlowski
2002/0095898 A1 * 7/2002 Bettencourt
2003/0145636 A1 * 8/2003 Nykoluk
2003/0159342 A1 * 8/2003 Ruiz et al. ..... 47/24.1
2005/0262626 A1 * 12/2005 Lewis

* cited by examiner

*Primary Examiner*—Gregory L Huson
*Assistant Examiner*—Karen Younkins
(74) *Attorney, Agent, or Firm*—Alfred M. Walker

(57) ABSTRACT

A zipper system for a safety swimming pool cover provides a convenient method of navigating around any vertical obstacles that may be within the pool cover area, when installing the pool cover over the pool. When a vertically extending obstacle, such as an entrance stair hand rail extends above the surface of a swimming pool cover, the swimming pool cover is split in the area of the obstacle, the zipper enables the user to securely navigate around the obstacle without compromising the tight fit of the swimming pool cover. The zipper closes the split area around the obstacle quickly and neatly. The zipper also prevents the entrance of debris into the pool around the split area. The zipper alternatively provides access to a selected area of the pool, such as a spa area. The spa area, when not in use, can be zipped and covered.

11 Claims, 6 Drawing Sheets

OBSTACLE AVOIDANCE METHOD FOR POOL COVERS USING ZIPPER ELEMENTS

FIELD OF THE INVENTION

The present invention relates to securing pool covers around protruding obstacles, and to gain access to covered relaxation spas.

BACKGROUND

Pool covers for in-ground pools are attached by taut straps at the periphery of the cover which are attached to anchors in the decking around the pool. The flexible cover is to lay taut over the edge of the pool roughly in a plane parallel to the water surface.

Unfortunately, obstructions which extend vertically over the level of the pool edge often interfere with the pool cover. These may be poles or columns supporting canopies or roofs close to the edge of the pool; other obstructions such as a handrail adjacent steps leading to the pool bottom may actually extend into the pool water region.

In these areas, the pool cover must be split to permit the cover to go around the obstacle so that it can again lay horizontally at the level of the decking or pool edge. The split area must be again attached to maintain the integrity of the pool cover.

Currently, a series of straps and buckles are used to re-join the edges of the split regions of the pool cover. These straps and buckles add weight to the pool cover in localized areas making installation and removal more cumbersome. They also aesthetically detract from an otherwise streamlined appearance. Extra personnel are sometimes required to handle the cover in the obstacle areas and also to detach and re-attach straps which are rather labor intensive.

The prior art shows the use of zippers attached to pool covers. U.S. Pat. No. 4,109,325 of Shuff describes an inflatable pool cover with integral weighted skirts which are usually submerged. By introducing pressurized air under the pool cover, it can be made to rise above the edge of the pool.

U.S. Pat. No. 5,621,926 of La Madeleine describes a swimming pool cover system wherein the pool cover is attached to the periphery of the pool, but the center is raised by a cable on a boom to form a type of tent canopy over the pool.

In both of these patents of Shuff '325 and La Madeleine '926, zippers in the pool cover are used to permit a sealable opening to admit swimmers to use the pool with the pool cover attached, to take advantage of the space provided between the pool surface and the pool cover.

U.S. Pat. No. 5,722,098 of Stern describes a pool cover with drainage and filter means, wherein the filter and drain region is attached to the central region of a pool cover by some mechanism, among which is a zipper.

U.S. Pat. No. 6,691,334 of St-Hilaire describes a swimming pool covering structure in two parts. In St-Hilaire '334, the zipper is an integral part of the actual covering of the pool. A flexible central section extends over the water area of the pool. A flexible anchoring section is attached to the edge of an above-ground pool or to the deck surface around an in-ground pool much like a frame. The central section is then attached to the anchoring section using a long zipper extending all the way around the edge of the pool.

None of the cited prior art patents make use of one or more sliding zipper elements to permit a pool cover to be fitted around vertical obstacles over the water or deck areas. None of the cited patents uses a zipper to make a certain part of the covered areas removable to gain access to an adjacent feature, such as a spa area.

Also, the prior art does not relate to safety pool covers which must comply with ASTM specifications.

OBJECTS OF THE INVENTION

It is therefore an object of the present invention to provide a pool cover which is fitted tightly and securely around vertically extending obstacles and/or auxiliary structures such as spas.

Other objects which become apparent from the following description of the present invention.

SUMMARY OF THE INVENTION

The QUIK-LOC™ zipper system of the present invention is a heavy duty sliding zipper element rated at 600 pounds per inch, which is the same rating as the rest of a pool cover. This maintains the flexible cover taut to meet ASTM standards for safety. The QUIK-LOC™ zipper system provides a convenient method of navigating around any vertical obstacles that may be within the pool cover area.

Currently, when a vertically extending obstacle, such as an entrance stair hand rail extends above the surface of a swimming pool cover, the swimming pool cover is split in the area of the obstacle, but numerous straps and buckles need to be joined together along the length of the open area to rejoin the two edges together to maintain the integrity of the pool cover.

Gaps are left between the two edges which permit debris such as leaves and twigs to enter the pool area between the straps. The buckles and straps add weight to the pool cover and require additional time to secure each strap.

The use of the QUIK-LOC™ zipper, instead of the conventional array of straps, closes the split area around the obstacle quickly and neatly, improving the aesthetic appearance, by substituting the clean uniform look of a zipped section for the ragged appearance of numerous straps with free hanging ends.

The sliding zipper also prevents the entrance of debris into the pool around the split area.

To secure the QUIK-LOC™ zipper in place and prevent a child or other unauthorized person from opening it, a fastener, such as a flexible cable (preferably stainless steel), is passed through the handle area of the slide or latching mechanism of the QUIK-LOC™ zipper (it is noted that the slide is about two inches long).

The cable is then looped through two "D" rings sewn at the end of each side of the looped area. A locking fastener, such as a padlock hasp is then passed through the loops which are at both ends of the cable.

A second application for QUIK-LOC™ is for ease in removal to access a particular area of a pool, such as a spa area. The area when not in use can be zipped and covered, still maintaining the safety cover feature, but when entry is needed, only a quick unzippering and removal of certain springs with straps need be removed to access to the desired area.

The process still will require the unlocking of the lock by an authorized person, but the time and effort involved after will be greatly reduced.

Once the area is no longer needed, it just need be re-zipped and locked via cable and padlock and attachment of the springs and straps. It should be noted that during the uncover of any section, the pool cover is not considered safe again until the area removed is replaced, the QUIK-LOC™ is re-zipped, and cable is again installed and locked to meet ASTM standards.

In use, the swimming pool is covered by navigating around any vertical obstacles, such as access handrails, that may be within the pool cover area. The pool cover is split into one or more laterally extending cuts, each having a pair of joinable edges from a peripheral edge to an open area of a vertically extending obstacle extending above the pool cover. The joinable edges are joined by a heavy duty zipper, thereby capturing the obstacle along the length of the split laterally extending cut open area to rejoin the two edges together. The zipper closes respective gaps left between the two edges of the zipper and prevents debris such as leaves and twigs to enter the pool area between the joinable zipper edges.

The heavy duty sliding zipper is secured in place to prevent a child or other unauthorized person from opening it by a lock. In one embodiment, a cable having closed loops at opposite ends thereof is provided. The cable is passed through a handle area of the heavy duty sliding zipper and then through one or more rings attached at an end of each respective side of the looped area of said cable. A lock, such as a padlock, is passed through the pair of loops at the respective opposite ends of the cable.

The present invention can also be used to allow access to a pool spa located in a region adjacent to the main swimming pool, independent of the swimming pool being covered. An extension flap to the pool cover extending from one or more edges of the pool cover while covering the spa. The flap is zippered to allow entry into said spa area without removal of the main pool cover from the swimming pool. The pool cover extension flap is split into a pair of laterally extending cuts, each having a pair of joinable zipper edges. The cuts extend from an outer distal peripheral edge thereof to an open area between a spaced apart edge of the spa closest to the pool. The two splits extend beyond the outer lateral edges of the spa. When not in use, the spa can be covered and secured by a similar locking means as provided for the splits in the main pool cover, such as by also providing a cable having closed loops at opposite ends thereof and passing the cable through a handle area of said heavy duty sliding zipper and passing the cable through a plurality of rings attached at an end of each respective side of the looped area of the cable. A padlock hasp is then passed through the pair of loops at the opposite ends of the cable.

The zipper closes the split area around the main swimming pool obstacle or adjacent spa area quickly and neatly. The zipper also prevents the entrance of debris into the pool around the split area.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
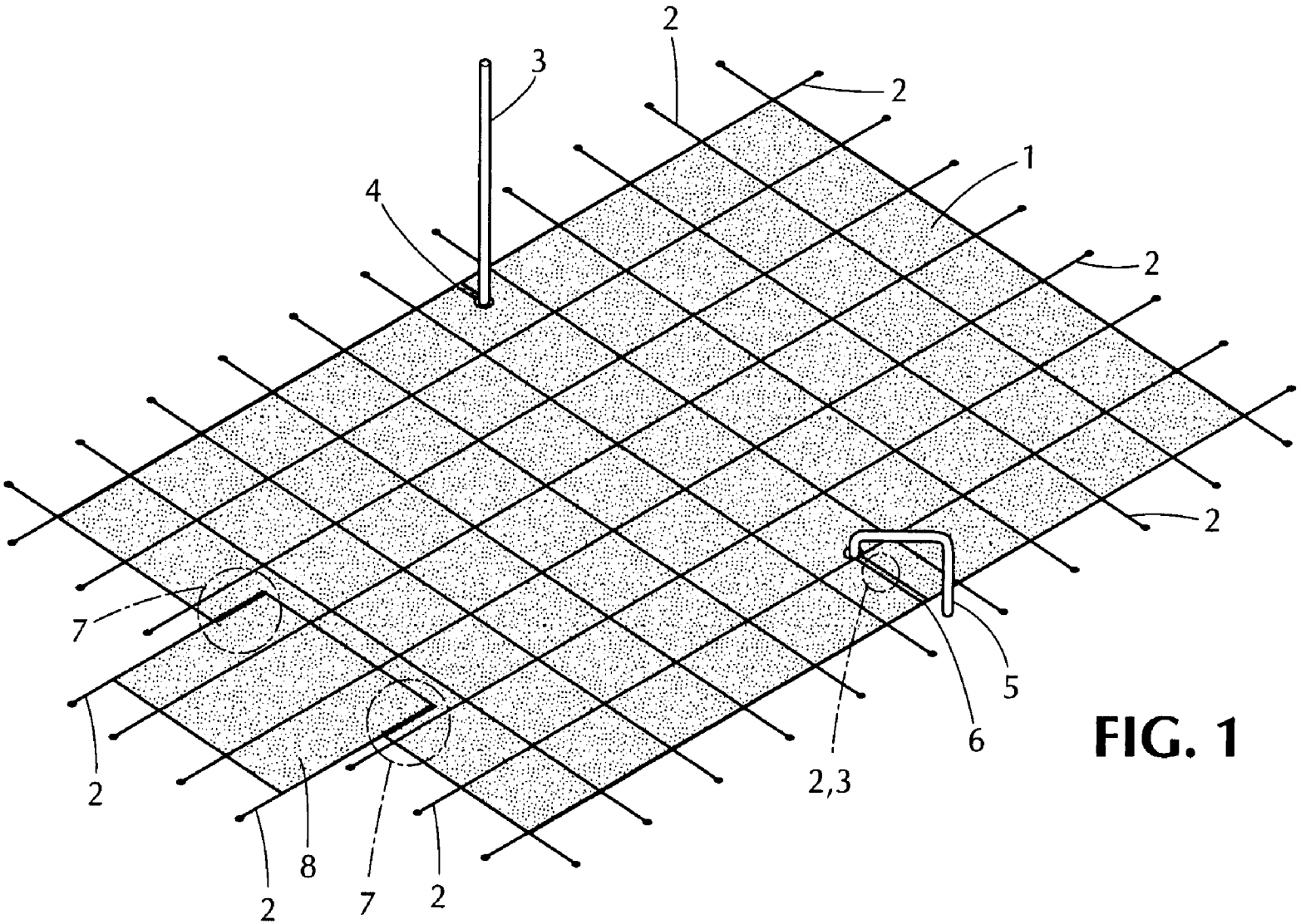
FIG. 1 is a perspective view of a pool with safety pool cover showing obstacles and a separate end area covering a spa section.

The general method of accommodating vertical obstacles protruding through safety pool covers is shown in FIG. 1. Pool cover 1 with taut attachment straps 2 attached to the deck area is penetrated by pole 3 and handrail 5. In both cases, the edge is split (at 4 and 6 respectively) to navigate around the obstacle. In both cases the splits are re-closed to maintain the safety integrity of pool cover 1. Pool cover extension 8 covers a separate spa area adjacent to the main pool. It is attached to the main section of pool cover by a removable closure system at line 7 to permit use of the spa area without the need to detach tension straps 2. The attachment technique is regulated by ASTM to insure the safety integrity of pool cover 1.

Figure 3:
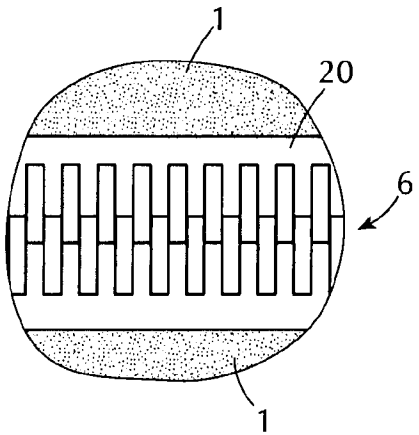
FIG. 3. Is a top view detail of the same area as in FIG. 2 as it appears with the QUIK-LOC™ zipper of this invention.
Figure 2:
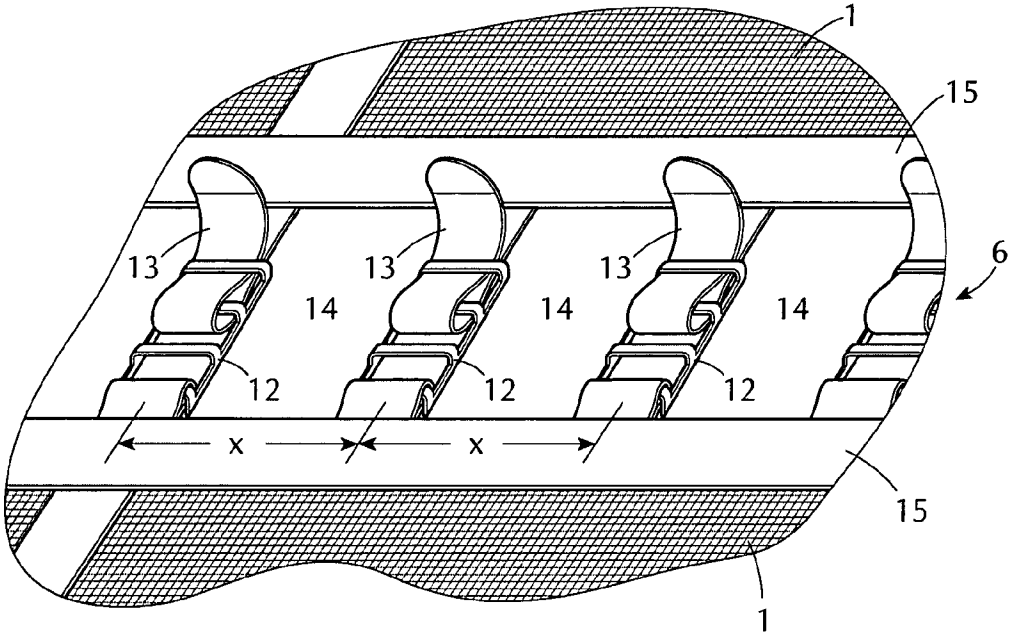
FIG. 2 PRIOR ART
FIG. 2 is a perspective detail of the prior art method of using multiple straps and buckles to close a split area under a handrail shown in FIG. 1.

The method used for removable closure of obstacle splits or removable pool cover extensions of this invention is to use a sliding QUIK-LOC™ heavy duty zipper to replace the prior art array of straps. The differences between the appearance of the two methods is illustrated in FIGS. 2 and 3. These are enlarged details of the area indicated under the handrail of FIG. 1.

FIG. 2 shows prior art straps 13 engaged with buckles 12 closing a split between two edges of pool cover 1 as lined with reinforcing ribbons 15. Open regions 14 are visible between straps and buckles. Regulations specify the strap spacing "X" to be 3" over water and every 6" over decking to maintain the pool cover strength integrity. The time to engage or disengage such an array of straps is quite long and tedious.

As a contrast, the neat appearance of QUIK-LOC™ zipper 20 closing split 6 is shown in FIG. 3. It is noted that no open spaces comparable to regions 14 are evident since QUIK-LOC™ zipper 20 prevents entry of debris into the pool through the split area. The time to engage or disengage zipper 20 is negligible as compared to multiple straps 13 and buckles 12. QUIK-LOC™ zipper 20 can also be used as the attachment method of cover extension 8 to main cover 1 along line 7 as shown in FIG. 1. Although illustrated as a straight line in FIG. 1, attachment junction using sliding zipper 20 can be curved as well.

Figure 5:
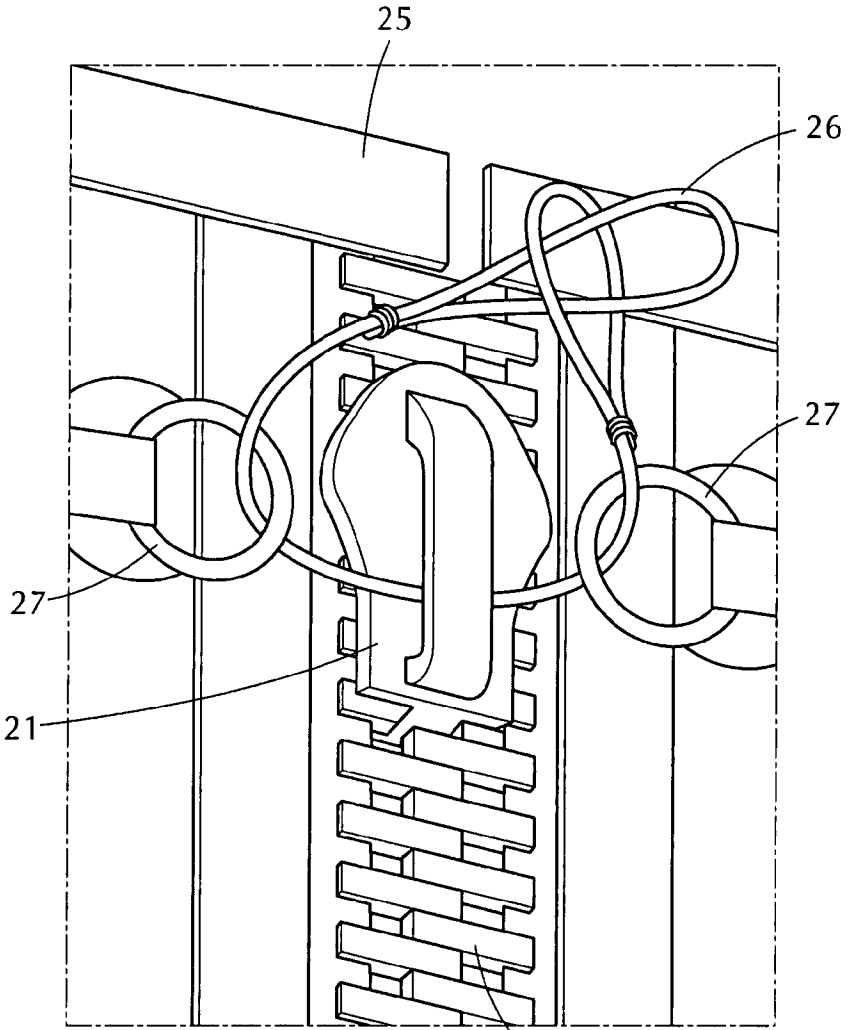
FIG. 5 is a perspective detail of the cable locking system used with the QUIK-LOC™ zipper of this invention.
Figure 4:
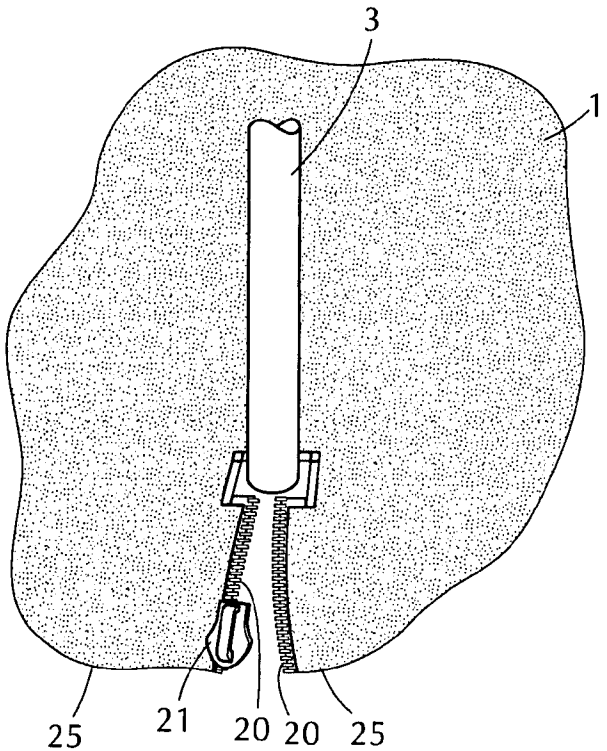
FIG. 4 is a perspective detail of an edge region of pool cover split apart to accommodate a support pole obstacle while using a QUIK-LOC™ zipper.

FIG. 4 illustrates the placement of an open split using sliding zipper 20 around the obstacle of pole 3 at the edge 25 of pool cover 1. Slide 21 is engaged with one side of the open sliding zipper 20. FIG. 5 shows the locking method. The locking system of QUIK-LOC™ zipper 20 involves the use of cable 26 which has loops at each end. This is guided under the handle of slide 21 as shown which has a slot to accommodate the loops at the ends of cable 26. Cable 26 is also looped through closed rings, such as "D" rings 27, which are sewn to each side of the split. A padlock (not shown) hasp is then conveniently engaged through both cable 26 loops and snapped locked.

Figure 6:
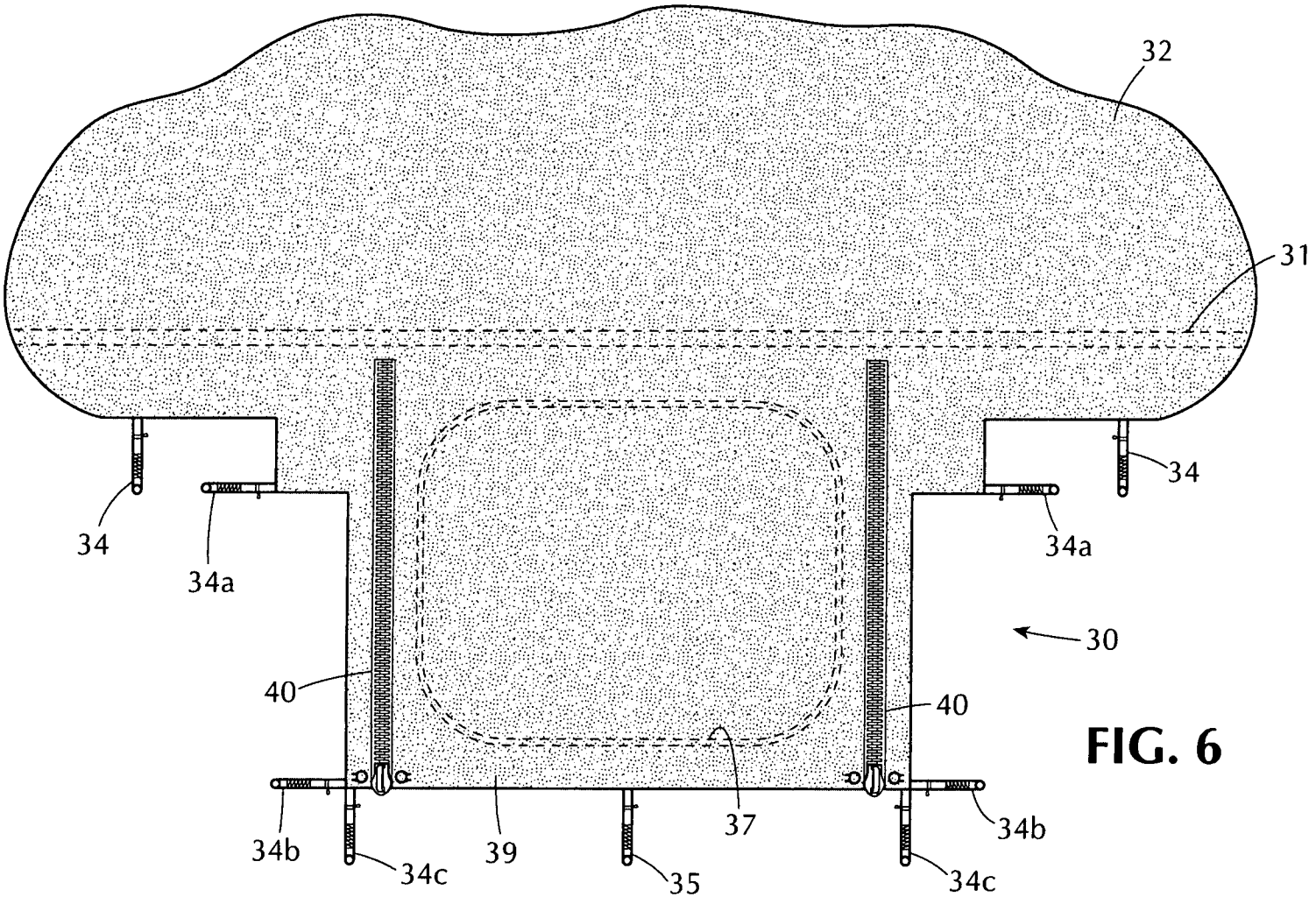
FIG. 6 is a top view detail showing two parallel QUIK-LOC® zippers used to cover a rectangular spa area adjacent to a pool with an extension of the main safety pool cover.
Figure 7:
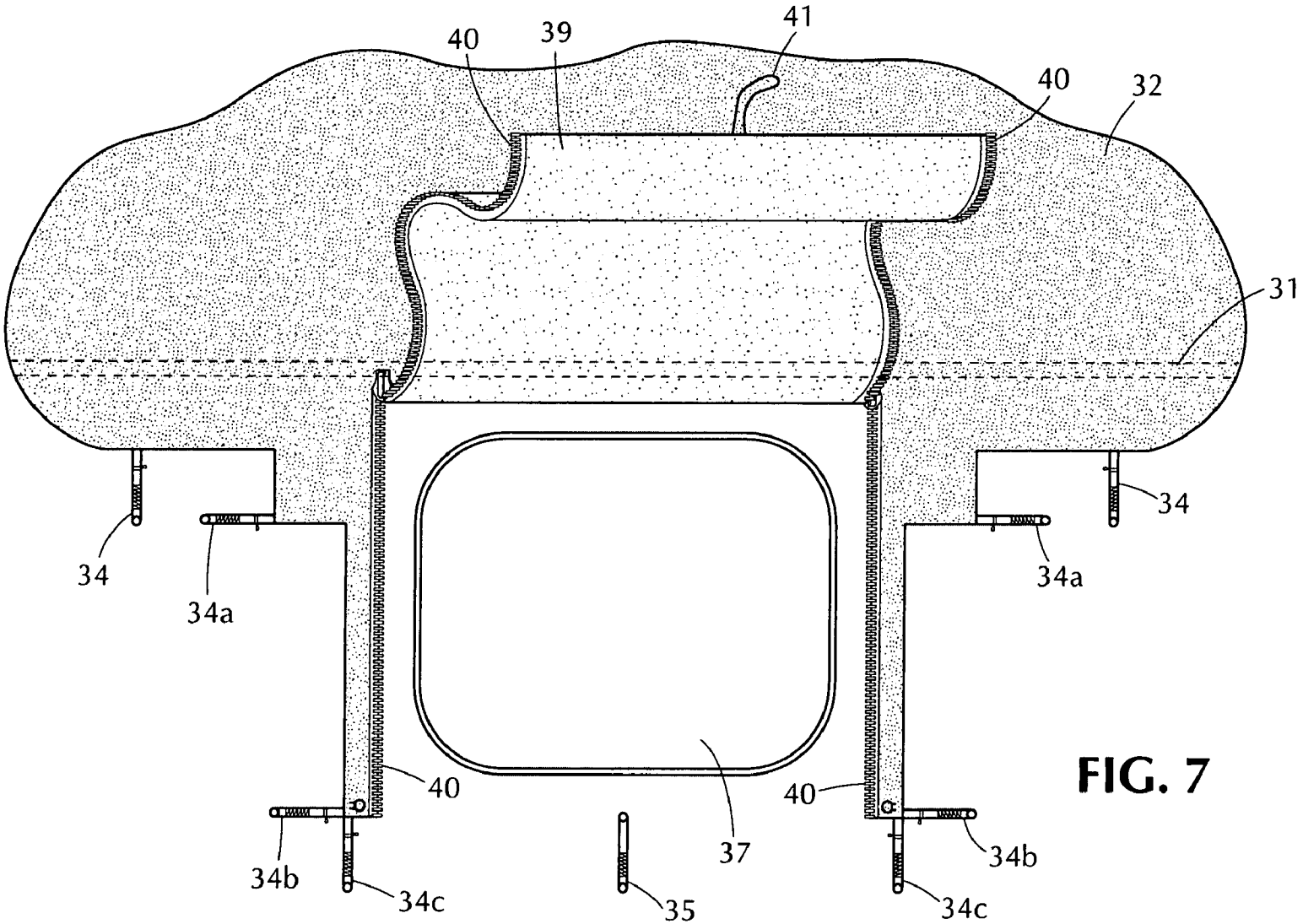
FIG. 7 is a top view of the same detail as that in FIG. 6 with the movable flap opened to gain access to the spa.
Figure 8:
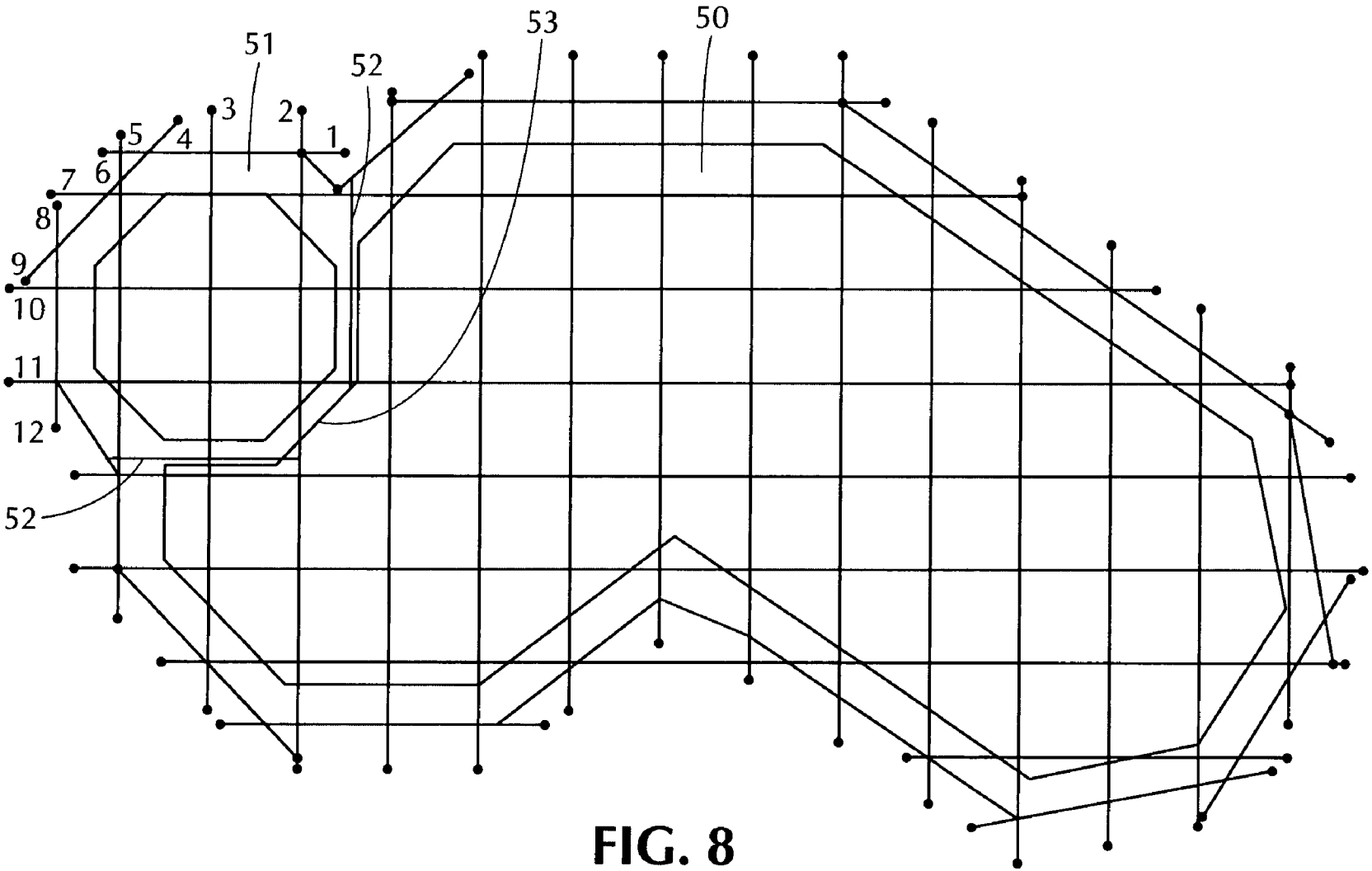
FIG. 8 is a top plan view of an angular shaped pool with a spa area adjacent one end covered by an extension of the main pool safety cover and using two QUIK-LOC® zippers at right angles to each other.

Multiple QUIK-LOC® zippers are sometimes used on extensions of pool safety covers to cover adjacent features such as a spa. FIGS. 6 and 7 illustrate the use of two parallel zippers to cover a rectangular spa, while FIG. 8 shows a plan for using two zippers at right angles to each other to cover a 7-sided angular spa. Obviously two or more QUIK-LOC® zippers at various angles can be used to accommodate other custom installations.

FIG. 6 shows safety pool cover extension 30 which is part of main pool cover 32 used to cover spa 37 which is adjacent to the edge 31 of the pool. Movable flap 39 is shown zipped in place by QUIK-LOC® zippers 40 thereby covering spa 37. Tension deck straps 34 attach the main pool cover 32 as well as extension 30 to the deck surface.

Central straps 35, 34*a* and 34*b* are the only ones that needs to be undone to permit use of the spa area as shown in the accessible configuration in FIG. 7. Strap end 41, 34*a* and 34*b* are detached from anchors prior to unzipping zippers 40, then flap 39 is simply folded over main cover 32.

FIG. 8 shows main safety pool cover 50 with an extension 51 covering an adjacent angular spa area. Here two QUIK-LOC® zippers 52 at right angles to each other are used to gain access to the spa area by unzipping and folding the entire extension 51 over main cover 50 creating a fold at a line intersecting the close ends of zippers 52 (indicated by item number 53). Only the deck straps around the periphery of the spa area need be undone.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A cover with a swimming pool comprising:

a flexible sheet of material covering substantially all of an opening into said swimming pool, said swimming pool having one or more upwardly extending obstacles;

an opening in said flexible sheet of material shaped to correspond to an outer contour of each of said obstacles when said cover is deployed on said swimming pool;

a split in said flexible sheet of material extending from each said opening to a side of said cover; and zipper elements lining edges of said split in said cover for a sliding zipper to zipper shut edges of said split, from said side of said cover to said opening, said zipper elements terminating at, and not extending along an edge of said opening, thereby preventing debris from entering said swimming pool through an area of said split.

2. The cover of claim 1 in which said zipper elements are heavy duty and rated at 600 pounds per inch.

3. The cover of claim 2 in which one of said obstacles is an entrance stair hand rail.

4. The cover of claim 3 having rings to lock said zipper elements when said split is zippered shut by said sliding zipper, said rings attached to said cover on opposite sides of said split, and a cable having looped ends passing through said rings and an opening in said sliding zipper to prevent movement of said sliding zipper and to keep said split closed.

5. The cover of claim 3 in which said cover has an extension covering a separate spa area adjacent to said swimming pool opening, said extension being zippered to said cover to be folded back over said cover and allow entry into said spa area without removal of said cover from said swimming pool.

6. A method of covering an opening in a swimming pool having upwardly extending obstacles comprising the steps of:

placing a flexible sheet of material over substantially all of said opening into said swimming pool, said flexible sheet of material having an obstacle opening corresponding to each of said obstacles when said cover is deployed on said swimming pool and a split extending from each obstacle opening to a side edge of said flexible sheet of material; and, using zipper elements of a sliding zipper lining respective edges of said split, to zipper shut said split, from said side edge of said flexible sheet of material only up to said obstacle opening, thereby preventing debris from entering said swimming pool through an area of said split.

7. The method of claim 6 including the step of maintaining said zippered elements in place when said split is shut by passing a cable having looped ends through an opening in said slide and rings mounted on said cover on opposite sides of said split.

8. A method of covering a swimming pool by navigating around any vertical obstacles that may be within the pool cover area comprising the steps of:

providing a pool cover covering the pool area;

splitting said pool cover from a peripheral edge to an open area of a vertically extending obstacle extending above said pool cover into a laterally extending cut having a pair of joinable edges;

providing a heavy duty sliding zipper and pool cover rated at a strength of at least 600 pounds per inch;

joining together said pair of joinable edges capturing said obstacle along the length of said split laterally extending cut open area to rejoin the two edges together with said heavy duty sliding zipper to maintain the integrity of the pool cover, said sliding zipper extending only up to an edge of said open area;

thereby closing respective gaps left between said two edges and preventing debris such as leaves and twigs to enter the pool area between said joinable edges;

securing said heavy duty sliding zipper in place to prevent a child or other unauthorized person from opening it by providing a cable having closed loops at opposite ends thereof and passing said cable through a handle area of said heavy duty sliding zipper; and passing said cable through a plurality of rings attached at an end of each respective side of said looped area of said cable.

9. A method of covering a swimming pool by navigating around any vertical obstacles that may be within the pool cover area comprising the steps of:

providing a pool cover covering the pool area;

splitting said pool cover from a peripheral edge to an open area of a vertically extending obstacle extending above said pool cover into a laterally extending cut having a pair of joinable edges;

providing a heavy duty sliding zipper and pool cover rated at a strength of at least 600 pounds per inch;

joining together said pair of joinable edges capturing said obstacle along the length of said split laterally extending cut open area to rejoin the two edges together with said heavy duty sliding zipper to maintain the integrity of the pool cover, said sliding zipper extending only up to an edge of said open area;

thereby closing respective gaps left between said two edges and preventing debris such as leaves and twigs to enter the pool area between said joinable edges;

securing said heavy duty sliding zipper in place to prevent a child or other unauthorized person from opening it.

10. A method of covering a swimming pool and adjacent separate spa while allowing access to said spa independent of said swimming pool, comprising the steps of:

providing a pool cover covering the pool area;

providing an extension flap of said pool cover extending from at least one edge of said pool cover, covering the adjacent separate spa area adjacent to said swimming pool opening, said extension flap being zippered to said cover to allow entry into said spa area without removal of said cover from said swimming pool;

splitting said pool cover extension flap into a laterally extending cut having a pair of joinable edges; said cut extending from an outer distal peripheral edge to an open area between an edge of said spa and a spaced apart adjacent area of said pool cover, said split extending outside of one side of said spa;

splitting said pool cover extension flap into a further laterally extending cut having a pair of joinable edges; said further cut extending from an outer distal peripheral edge to an open area between an edge of said spa and a spaced apart adjacent area of said pool cover; said split extending outside of an opposite side of said spa;

providing a heavy duty sliding zipper and a pool cover rated at a strength of at least 600 pounds per inch;

providing access to said spa by removing said extension flap along said laterally extending cuts and said outer distal peripheral edge from over said spa and folding said flap over said cover thereby uncovering said spa, while said swimming pool is covered by said pool cover;

joining together said pair of joinable edges capturing said spa between said split laterally extending cut open areas to rejoin the two edges together with said heavy duty sliding zipper to maintain the integrity of the pool cover;

thereby closing respective gaps left between said two edges and preventing debris such as leaves and twigs to enter the spa area between said joinable edges;

securing said heavy duty sliding zipper in place to prevent a child or other unauthorized person from opening it by providing a cable having closed loops at opposite ends thereof and passing said cable through a handle area of said heavy duty sliding zipper; and passing said cable through a plurality of rings attached at an end of each respective side of said looped area of said cable.

11. A method of covering a swimming pool and adjacent separate spa while allowing access to said spa independent of said swimming pool, comprising the steps of:

providing a pool cover covering the pool area;

providing an extension flap of said pool cover extending from at least one edge of said pool cover, covering the adjacent separate spa area adjacent to said swimming pool opening, said extension flap being zippered to said cover to allow entry into said spa area without removal of said cover from said swimming pool;

splitting said pool cover extension flap into a laterally extending cut having a pair of joinable edges; said cut extending from an outer distal peripheral edge to an open area between an edge of said spa and a spaced apart adjacent area of said pool cover, said split extending outside of one side of said spa;

splitting said pool cover extension flap into a further laterally extending cut having a pair of joinable edges; said further cut extending from an outer distal peripheral edge to an open area between an edge of said spa and a spaced apart adjacent area of said pool cover; said split extending outside of an opposite side of said spa;

providing a heavy duty sliding zipper and pool cover rated at a strength of at least 600 pounds per inch conforming to the same rating as said pool cover;

providing access to said spa by removing and folding over said extension flap along said laterally extending cuts and said outer distal peripheral edge from over said spa and uncovering said spa, while said swimming pool is covered by said pool cover;

joining together said pair of joinable edges capturing said spa between said split laterally extending cut open areas to rejoin the two edges together with said heavy duty sliding zipper to maintain the integrity of the pool cover;

thereby closing respective gaps left between said two edges and preventing debris such as leaves and twigs to enter the spa area between said joinable edges;

securing said heavy duty sliding zipper in place to prevent a child or other unauthorized person from opening it.

* * * * *